US007353622B2

(12) United States Patent
Bringewatt et al.

(10) Patent No.: US 7,353,622 B2
(45) Date of Patent: Apr. 8, 2008

(54) METHOD AND DEVICE FOR THE DRYING OF LAUNDRY

(75) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 10/527,620

(22) PCT Filed: Sep. 18, 2003

(86) PCT No.: PCT/EP03/10352

§ 371 (c)(1),
(2), (4) Date: Sep. 19, 2005

(87) PCT Pub. No.: WO2004/029351

PCT Pub. Date: Apr. 8, 2004

(65) Prior Publication Data

US 2006/0090367 A1 May 4, 2006

(30) Foreign Application Priority Data

Sep. 20, 2002 (DE) ..... 102 43 926

(51) Int. Cl.
*F26B 13/30* (2006.01)

(52) U.S. Cl. ..... 34/312

(58) Field of Classification Search ..... 34/595, 34/601, 606, 312; 68/3 R, 21
See application file for complete search history.

(56) References Cited

U.S. PATENT DOCUMENTS

| | | | | |
|---|---|---|---|---|
| 2,720,037 | A * | 10/1955 | Erickson | 34/526 |
| 3,747,841 | A * | 7/1973 | Ross | 210/368 |
| 3,861,865 | A * | 1/1975 | Grantham | 432/105 |
| 4,236,322 | A * | 12/1980 | Hastings | 34/130 |

FOREIGN PATENT DOCUMENTS

| | | | |
|---|---|---|---|
| CH | 227 12 | | 5/1943 |
| DE | 1 054 955 | | 4/1959 |
| DE | 1 150 325 | | 6/1963 |
| DE | 1 585 880 | | 1/1971 |
| DE | 29 25 958 | A1 | 1/1981 |
| DE | 199 06 020 | A1 | 8/2000 |
| DE | 101 19 835 | * | 10/2002 |
| EP | 0 083 302 | A1 | 7/1983 |
| EP | 0 909 848 | A1 | 4/1999 |
| EP | 1 118 704 | A1 | 7/2001 |
| GB | 952 039 | | 3/1964 |

* cited by examiner

*Primary Examiner*—S. Gravini
(74) *Attorney, Agent, or Firm*—Laurence P. Colton; Smith, Gambrell & Russell

(57) ABSTRACT

The invention proposes a spin dryer which makes it possible to drain the laundry to approximately the same extent as a laundry press. For this purpose, a rotatable drum of the spin dryer is driven at a high rotational speed such that the laundry inside the drum is exposed to a centrifugal force which amounts to at least 600 times gravitational acceleration.

7 Claims, 5 Drawing Sheets

METHOD AND DEVICE FOR THE DRYING OF LAUNDRY

BACKGROUND OF THE INVENTION

1. Technical Field

The invention relates to a method for the drainage of laundry, the laundry being spun in a drum capable of being driven in rotation, and, at the same time, the liquid contained in the laundry being as far as possible removed from the latter. The invention relates, furthermore, to devices for the drainage of laundry, with a drum for receiving a laundry batch, the said drum being capable of being driven about an axis of rotation by means of a drive, the drum having a preferably cylindrical surface area which is at least partially liquid-permeable; with a drum for receiving a laundry batch, the said drum being capable of being driven in rotation about a longitudinal mid-axis by means of a drive; with a drum for receiving a laundry batch, the said drum being capable of being driven in rotation by means of a drive, the drum having a preferably cylindrical surface area which is provided with a grid of liquid-permeable orifices; and with a drum for receiving a laundry batch, the said drum being capable of being driven in rotation by means of a drive, and with a plinth carrying the drum via a bearing stand.

2. Prior Art

Washed laundry is drained before drying, in order to separate from the laundry a large part of the liquid contained in the laundry from washing, what is known as the tied-up liquor. In commercial laundries, various devices, specifically, in particular, spin dryers and drainage presses, are used for draining the laundry. The devices for the drainage of laundry which are addressed by the invention are spin dryers.

Known spin dryers have a lower drainage capacity, as compared with drainage presses, that is to say only a smaller quantity of moisture can be separated from the laundry by means of spin dryers. Moreover, known spin dryers have a longer cycle time than drainage presses. However, drainage presses are not suitable for the drainage of every type of laundry, because the press rams exert a relatively high mechanical load on the laundry. Consequently, not every type of laundry can be drained in drainage presses. In particular, drainage presses are unsuitable for delicate laundry. In commercial laundries, therefore, spin dryers are still used, as before, in spite of the lower drainage capacity and longer cycle time. In so far as larger laundries are concerned, both drainage presses and spin dryers are used, spin dryers being employed essentially only for the drainage of delicate laundry. In smaller laundries, where the amount of laundry makes it uneconomic to use a spin dryer and a drainage press simultaneously, only a spin dryer can be employed so that laundry of any type can be drained. Then, in particular, the longer cycle times of spin dryers must necessarily be taken into account.

Starting from this, the object on which the invention is based is to provide a method and a device (spin dryer) for the drainage of laundry, by means of which any type of laundry can be drained economically.

BRIEF SUMMARY OF THE INVENTION

A method for achieving the object mentioned in the introduction is a method for the drainage of laundry, the laundry being spun in a drum capable of being driven in rotation, and, at the same time, the liquid contained in the laundry being as far as possible removed from the latter, characterized in that the drum is driven at a circumferential speed such that a centrifugal acceleration which is higher than 600 times gravitational acceleration acts on the laundry. Since the drum is driven at a high circumferential speed such that a maximum centrifugal acceleration of at least 600 times gravitational acceleration (g), preferably of up to 1000 times gravitational acceleration (g), acts on the laundry, the laundry can be freed of a large part of the liquid tied up in it by means of the spin dryer. The drainage capacity corresponds approximately to that of a laundry press. Above all, the high circumferential speed of the drum leads to a substantial shortening of the cycle time, as compared with known spin dryers, because the high circumferential speed leads not only to a higher drainage capacity, but also to a quicker separation of the liquid from the laundry. By means of the method according to the invention, a spin dryer can be operated with the same efficiency as a drainage press. Laundries therefore need to employ only spin dryers operating by the method according to the invention and not any additional drainage presses.

By means of the spin dryer according to the invention, all types of laundry can be drained, less delicate laundry being drained with maximum centrifugal acceleration at the highest possible circumferential speed of the drum, whereas, where delicate laundry is concerned, only the operating rotational speed of the drum is reduced, with the result that the circumferential speed and consequently also the centrifugal acceleration acting on the laundry fall or intermediate spinning with a centrifugal acceleration of below 600 times gravitational acceleration takes place. The method according to the invention, by continuous variation in the rotational speed of the drum, makes it possible even for the forces acting on the laundry during drainage to be metered in a controlled manner as a function of the type of laundry to be drained in each case and/or of the quantity of liquid (water) still tied up in the laundry.

According to a development of the method, there is provision for the drum to be loaded in a position in which the drainage, to be precise the spinning, of the laundry also takes place. Preferably, in this case, the axis of rotation of the drum is directed approximately horizontally. By the drum being loaded in the operating position in which drainage also takes place, the cycle time is shortened, because the operation of pivoting the drum after the loading is dispensed with. Above all, loading may take place even when the drum is rotating. After loading, the drum needs merely to be accelerated to its final rotational speed.

According to further preferred refinement of the method, during the loading of the drum the laundry is distributed as uniformly as possible on the inner circumference of the latter. Thus, the drum, by being loaded with the laundry, does not experience any appreciable unbalance which would have a particularly adverse effect when the drum is driven according to the invention at a very high circumferential speed.

The uniform loading of the drum with laundry preferably takes place in that the drum is driven in rotation during loading. Preferably, in this case, the rotational speed of the drum is lower than the maximum rotational speed during the drainage of the laundry. A rotational speed reduced in this way ensures a particularly uniform loading of the drum with the laundry.

According to the method, furthermore, there is provision, after the loading of the drum, for increasing the rotational speed of the latter quickly and continuously to the maximum rotational speed. This is carried out preferably such that a motor for driving the drum is operated with maximum torque during the continuous increase in the rotational speed of the drum. By the drum being run up quickly, the laundry is acted upon with maximum centrifugal acceleration in a short time after the loading of the drum. For example, the drum is accelerated in 20 to 50 s, preferably about 30 s, to the maximum rotational speed which corresponds approximately to 800 times gravitational acceleration. Effective drainage thereby takes place quickly, with the result that the cycle time of the spin dryer is markedly reduced, for example amounts to only 100 to 200 s, preferably about 120 s. As a result, in the method according to the invention, the cycle time is not appreciably longer than the cycle time of a drainage press having a comparable drainage capacity.

A device, in particular spin dryer, for the drainage of laundry has a drum for receiving a laundry batch, the said drum being capable of being driven about an axis of rotation by means of a drive, the drum having a preferably cylindrical surface area which is at least partially liquid-permeable, characterized in that the drive is designed to generate a pressing force corresponding to at least 600 times gravitational acceleration, for pressing the laundry against the inside of the surface area. Accordingly, the drive rotating the drum is designed in such a way that it imparts to the drum a maximum rotational speed which presses the laundry against the inside of the drum casing with a force which corresponds at least to 600 times gravitational acceleration, preferably amounts to 1000 times gravitational acceleration. Whereas known spin dryers press the laundry against the inside of the drum with only a pressing force which is markedly below 600 times gravitational acceleration, the spin dryer according to the invention makes it possible to act upon the laundry items with a centrifugal force such that a large part of the liquid is removed from the laundry within the shortest possible time. The drainage capacity of the spin dryer according to the invention is therefore comparable to the drainage capacity which has hitherto been achievable only with drainage presses which exert a high mechanical load on the laundry by means of the press ram.

The action upon the laundry during spinning with a centrifugal force which is above 600 times gravitational acceleration requires the drum to be driven at a correspondingly high rotational speed. At such a high rotational speed, an unbalance of the drum has a particularly serious effect, to be precise leads, in particular, to high loads on the bearings and on the drum. There is therefore provision for arranging the dynamic centre of gravity of the drum near the static centre of gravity of the latter, as a result of which unbalances, unavoidable if only because the laundry is not distributed a hundred percent uniformly on the circumference of the drum, do not have such a serious effect, even when the drum is driven at high rotational speed, that they could lead to damage to the spin dryer.

Preferably, the drum is designed to be short in relation to its diameter. Alternatively or additionally, the drive also has a compact, in particular short design. Expediently, moreover, the drive is assigned to the drum in such a way that the centre of gravity of the drive and of the drum is in proximity to the dynamic and/or static centre of gravity of only the drum. As a result, co-rotating parts of the drive and, in particular, couplings between the drive of the drum, cannot cause any appreciable unbalance.

A further device (spin dryer) for achieving the object mentioned in the introduction has a drum for receiving a laundry batch, the said drum being capable of being driven in rotation about a longitudinal mid-axis by means of a drive, characterized in that the drum can be pivoted about a pivot axis running perpendicularly through its longitudinal mid-axis. Since the drum is pivotable about a pivot axis running perpendicularly through the axis of rotation corresponding to its longitudinal mid-axis, the drum can be pivoted, while it can be driven in rotation, because, on account of the pivot axis extending through the axis of rotation, dynamic forces, in particular unbalance forces, of the rotating drum counteract the pivoting to the least possible extent, and the drive for pivoting the drum consequently does not have to be of unnecessarily powerful design. The pivot axis preferably runs horizontally.

According to a preferred refinement of the invention, the pivot axis is assigned at least one direct pivoting drive for pivoting the drum. The pivoting drive may be arranged directly on an end-face axle stub of the pivot axis. In this case, the pivot axis may serve at the same time for mounting the drive. The pivoting drive can thus be given a compact design and be mounted in a simple way. Above all, the pivoting drive of the pivot axis is designed in such a way that the motor serving for the drive or, if appropriate, a gear integrated into the motor is fastened and mounted directly on the respective end of the pivot axis.

A further device, in particular a spin dryer, for achieving the object mentioned in the introduction has a drum for receiving a laundry batch, the said drum being capable of being driven in rotation by means of a drive, the drum having a preferably cylindrical surface area which is provided with a grid of liquid-permeable orifices, characterized in that at least part of the cylindrical surface area has a grid of orifices such that the area of all the orifices amounts to at least 15% of the cylindrical surface area of the drum. Accordingly, the cylindrical casing of the drum has orifices which are distributed in a grid-like manner over the entire area of the said casing, the area of all the orifices amounting to at least 15% of the area of the cylindrical casing of the drum, preferably 20 to 30%. This affords the possibility, within a short time, of discharging a large part of the liquid tied up in the laundry outwards through the surface area of the drum. The liquid can thereby escape from the drum completely within the shortest possible time, with the result that a build-up of liquid on the inside of the cylindrical surface area of the drum is avoided.

The orifices are preferably cylindrical passage bores with a diameter which is smaller than the sheet-metal thickness of the drum. This diameter may be in the range of 2 mm to 4 mm, in particular about 3 mm. A large number of passage bores of relatively small diameter are provided, which are all identical to one another and are produced by drilling. In these passage bores which have special dimensioning, parts of the laundry or of the fabric cannot become caught, specifically, in particular, when the drum is driven at a relatively high rotational speed of up to about 1000 revolutions per minute in order to carry out the method according to the invention. As a result, after spinning, the laundry can also be separated easily from the wall of the cylindrical drum for the complete and rapid unloading of the spin dryer. Additional measures for detaching the laundry from the surface area of the drum may therefore be unnecessary. Even when the laundry is virtually dry and therefore relatively light due to the drainage which has for the most part taken place, its weight is sufficient for it to be detached from the surface area of the drum by means of gravity.

The wall thickness of the sheet metal, preferably produced from high-grade stainless steel, for forming the cylindrical casing of the drum amounts to between 4 mm and 8 mm, preferably to about 5 mm. With such a wall thickness, the passage bores of small diameter can be formed in the drum without any deformation, because the diameters of the orifices are smaller than the wall thickness of the drum. The drum thus acquires sufficient stability in spite of a large proportion of orifices in its cylindrical surface area. In particular, the said sheet-metal thickness of the wall of the drum allows a drilling of the passage bores without distortions of the cylindrical configuration of the surface area of the drum. The formation of the drum from sheet metal having the said thickness also makes it possible to grind the drum after the drilling of the passage bore, in order to remove completely the burr occurring during drilling. Preferably, the drum is ground, so as to be free of adhering fibres, only on the inside. In a preferred refinement of the invention, the ground inner surface of the drum is also electropolished. The term "electropolishing" is understood to mean electrolytic or galvanic polishing by the galvanic removal of surface roughness in an electrolyte.

In order to obtain the proportion, relatively high according to the invention, of passage bores in the surface area of the drum, the spacings of the passage bores with respect to their centre points (division) are approximately identical both in the longitudinal and in the circumferential direction of the cylindrical casing of the drum. Preferably, the spacings of the centre points, that is to say divisions, of the passage bores in the longitudinal direction of the drum amount to 0.3 to 1.0% of the diameter of the drum, in particular to about 0.50 to 0.80%. Such a narrow grid of passage bores, which results virtually in a uniform perforation of the surface area, results, in spite of the relatively small diameter of these, in an overall relatively high proportion of orifices with respect to the total area of the cylindrical casing of the drum, thus ensuring that even large quantities of liquid occurring during drainage are discharged from inside the drum uniformly over the entire area of the drum.

A further device for achieving the object mentioned in the introduction has a drum for receiving a laundry batch, the said drum being capable of being driven in rotation by means of a drive, and with a plinth carrying the drum via a bearing stand, characterized in that the plinth is designed at least partially as a storage tank for liquid removed from the laundry. Since the plinth is designed at least partially as a storage tank for liquid removed from the laundry, the storage tank can be of relatively large design; for there is normally sufficient space available in the region of the plinth. Accommodating the storage tank in the plinth makes separate storage tanks unnecessary, and therefore the device can be accommodated in a very space-saving way in a laundry.

The storage tank is designed at least for receiving the entire liquid quantity which occurs during a drainage operation. Preferably, however, the storage tank is designed for receiving the entire liquid quantity occurring during a plurality of drainage operations. The storage tank can thereby be used as an intermediate store, so that the water occurring during drainage does not have to be supplied immediately for reuse. The drainage operation can thereby be decoupled from another treatment, in particular in a washing machine, in which the liquid occurring during drainage is to be reused.

BRIEF SUMMARY OF THE DRAWINGS

A preferred exemplary embodiment of the device according to the invention (spin dryer) and of a method for the drainage of laundry is explained in more detail below with reference to the drawing in which.

DETAILED DESCRIPTION OF THE PREFERRED EMBODIMENTS

The device shown here is a spin dryer 10 for use in commercial laundries. By means of the spin dryer 10, washed laundry is drained, with the liquid contained in the laundry, what is known as the tied-up liquor, being removed at least for the most part dynamically, to be precise by means of centrifugal forces.

Figure 1:
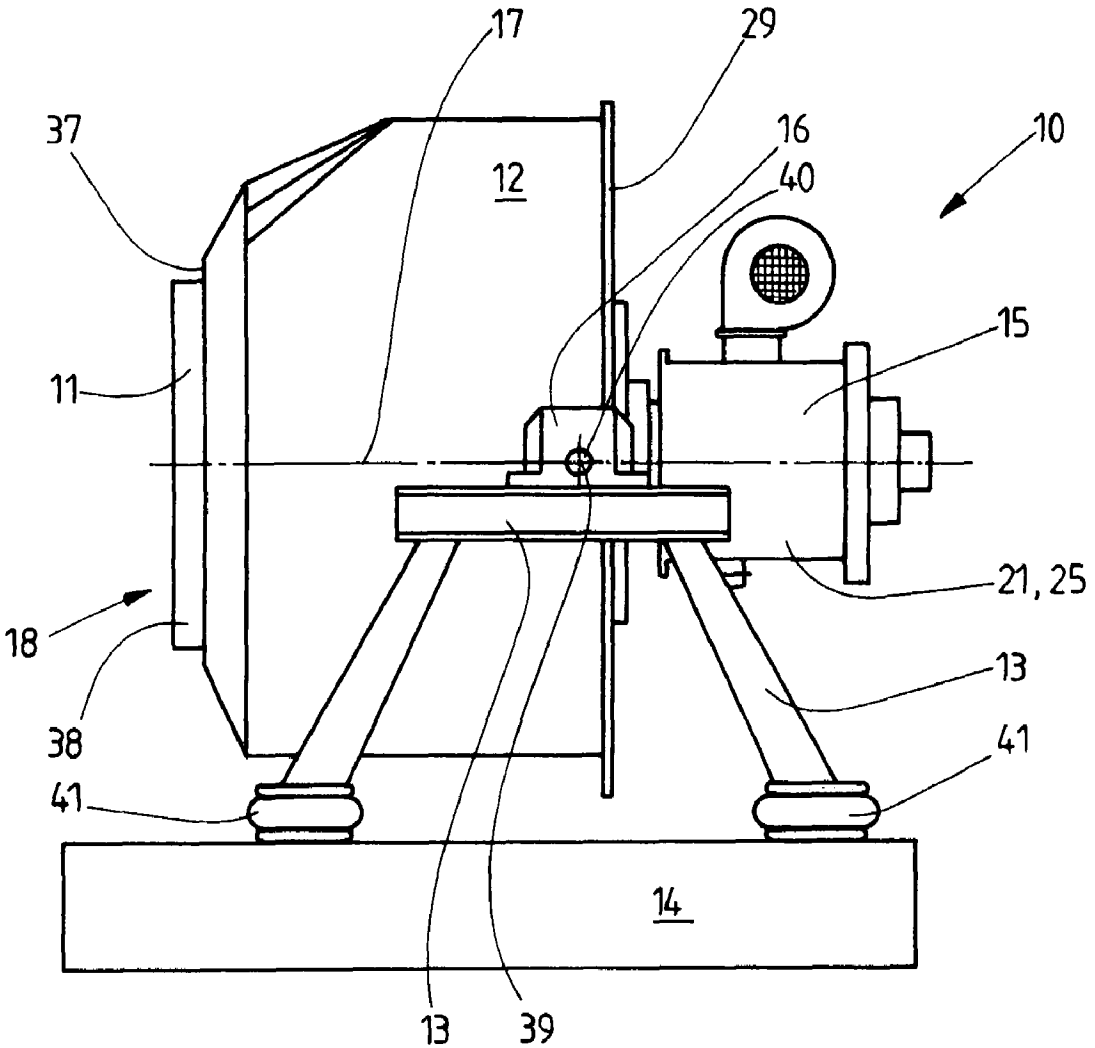
FIG. 1 shows the device according to the invention, to be precise a spin dryer, in a basic front view.

The spin dryer 10 illustrated diagrammatically in FIG. 1 has a drum 11 capable of being driven in rotation and having an at least partially perforated drum casing, a liquid-tight outer drum 12 surrounding the drum 11, a bearing stand for mounting the outer drum 12 together with the drum 11 arranged in the latter, a plinth 14 carrying the bearing stand 13, a drive 15 for the drum 11, and a pivoting drive 16.

The drum 11 is of essentially cylindrical design and can be rotated about its longitudinal mid-axis 17 by the drive 15. In the exemplary embodiment shown, the longitudinal mid-axis 17 of the drum 11, the said longitudinal mid-axis consequently serving at the same time as an axis of rotation, runs horizontally at least during drainage and preferably also during loading (FIG. 1). The drum 11 is partially open on one side, to be precise is provided with a loading and unloading orifice 18. At least the cylindrical surface area 20 of the drum 11 is perforated at least for the most part, with the result that liquid separated from the laundry located inside the drum 11 can be discharged outwards through the liquid-permeable surface area 20 of the drum 11, the laundry thereby being separated from the spun-out liquid. The diameter of the drum 11 preferably amounts to 1000 mm to 2000 mm, in particular to about 1450 mm. The length of the drum may amount to 500 mm to 1000 mm, preferably to 750 mm.

The perforation of the cylindrical drum casing is formed by a multiplicity of passage bores 19 which amount to 15 to 30%, preferably about 20%, of the surface area 20 of the drum 11. The passage bores 19 are produced by drilling. All the passage bores 19 are designed with identical size and are arranged so as to be distributed in a uniform grid over a large part of the cylindrical surface area 20 of the drum 11. In this case, circumferentially running rows of passage bores 19 lying in succession follow one another closely, the passage bores 19 of one row being offset with respect to the passage bores 19 of the adjacent row, specifically in each case by the amount of half a spacing (division) of two successive passage bores 19. Each of the identically designed passage bores 19 has a diameter of preferably 2 mm to 4 mm. In the exemplary embodiment shown, the diameter of the respective passage bore 19 amounts to about 3 mm. The spacing of successive passage bores 19 in the respective cylindrically continuous row amounts to 0.3% to 1.0% of the diameter of the drum 11. Preferably, the spacing (division) amounts to about 0.6% to 0.7% of the diameter of the drum 11. In the spin dryer 19 shown here, with a diameter of the drum 11 of about 1445 mm, the spacing, identical between all the successive passage bores 19, between two adjacent passage bores 19 in each case amounts to about 8 mm to 12 mm. The spacing of the cylindrical rows of successive passage bores 19 in the direction of the longitudinal mid-axis 17 of the drum 11 is equal or virtually equal to the spacing between successive passage bores 19 in the circumferential direction of the drum 11. Preferably, the spacing of the cylindrical rows of the passage bores 19 is somewhat smaller than in the circumferential direction, specifically by the amount of up to 1 mm.

The thickness of the sheet metal for forming at least the cylindrical surface area 20 of the drum 11 amounts to 4 mm to 7 mm. In the exemplary embodiment shown, the wall thickness amounts to about 5 mm. After the passage bores 19 have been drilled into the sheet metal for forming the surface area 20, a bur occurring at the edges of the passage bores 19 is ground, specifically in such a way that it is free of adhering fibres. Preferably, the entire inside of the drum 11 is ground and subsequently electropolished. The outside of the drum 11 has no need to be ground, in particular electropolished. The above-described perforation specially designed according to the invention, in particular the ratio of the diameters of the passage bores 19 to the division, ensures that, even at high spinning rotational speeds, the laundry does not adhere in or on the passage bores 19 and, nevertheless, even large quantities of liquid which occurs can be discharged quickly and completely through the surface area 20 of the drum 11.

Figure 5:
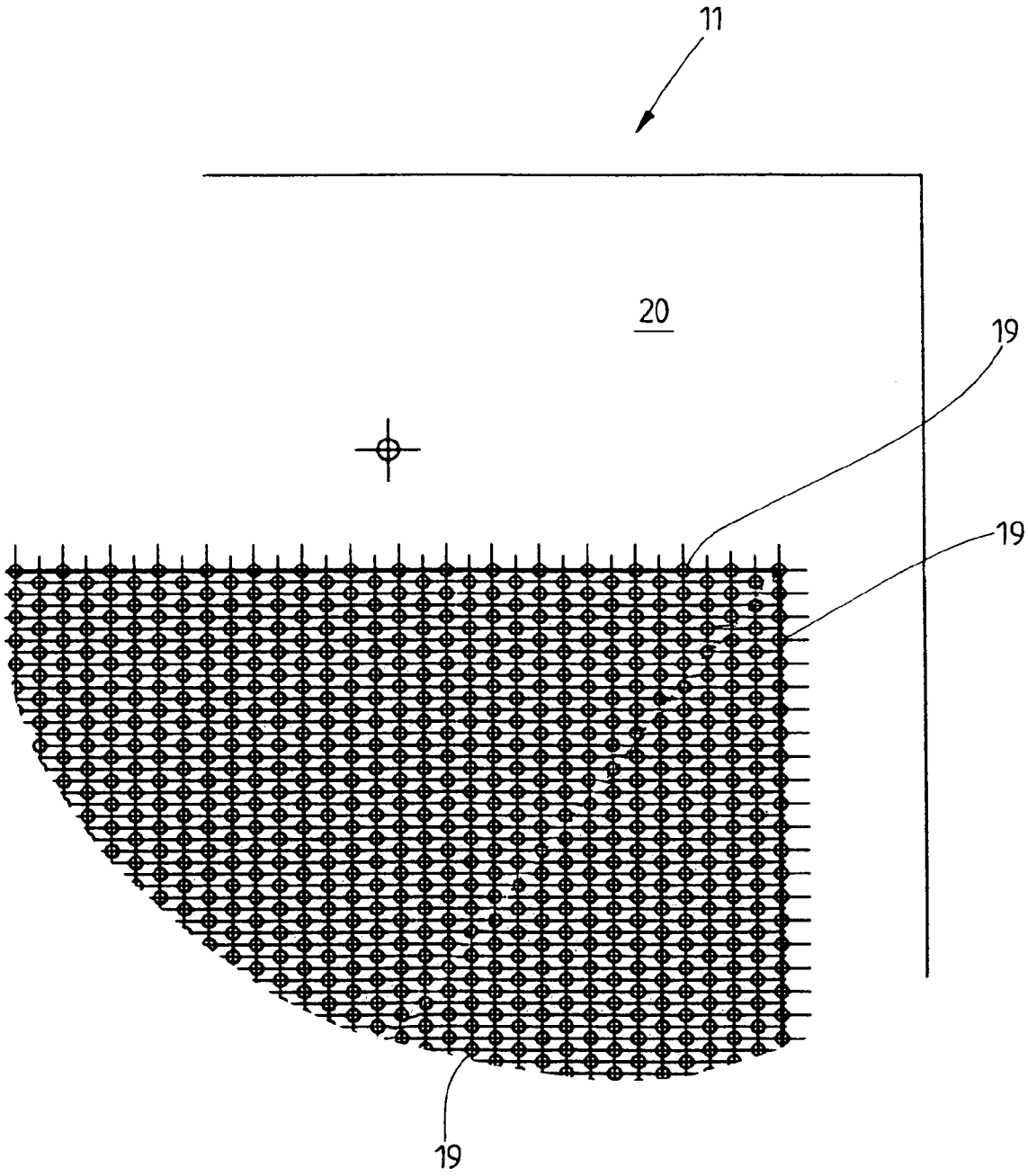
FIG. 5 shows a detail of a casing sheet of the drum with a partially illustrated hole grid.

FIG. 5 shows part of a rectangular sheet metal blank. The surface area 20 of the drum 11 is composed of a plurality of such sheet metal blanks. Each casing blank is perforated with a uniform grid of passage bores 19 in a large-area inner region only. Narrow outer edge regions are unperforated. The cylindrical surface area 20 is obtained from a plurality of such rectangular sheet metal blanks, the perforation which consists of the passage bores 19 extending only over a large part of the surface area 20, that is to say not over the entire surface area 20. It is also conceivable, however, to perforate the entire surface area 20 by means of a uniform grid of a large number of passage bores 19. This applies particularly when the entire surface area 20 is formed from a one-piece cylindrical casing sheet.

The drum 11 can be driven in rotation about the longitudinal mid-axis 17 by means of a direct drive, specifically an electric motor 21. The drum 11, on its side located opposite the loading and unloading orifice 18, has an end wall 22, by means of which the drum 11 is mounted directly on a drive shaft 23 of the electric motor 21. The drive shaft 23 also carries a rotor 24 of the electric motor 21. The drive shaft 23 is mounted rotatably in a motor housing 25, specifically by means of rolling bearings 26 and 27 on opposite end faces of the motor housing 25. A rolling bearing 26 facing the end wall 22 of the drum 11 is designed in such a way that it also absorbs the force of the drum 11, in particular also unbalance forces which occur during the spinning of the laundry.

The drive shaft 23 of the electric motor 21 projects with a shaft stub 28 out of that end face of the motor housing 25 which points towards the drum 11. By means of this end face of flange-like design, the electric motor 21 is at the same time fastened to a rear end wall 29 of the outer drum 12, specifically, in the exemplary embodiment shown, releasably by means of a plurality of screws. The rear end wall 29 of the outer drum 12 thus also carries the electric motor 21 and the drum 11 mounted on the drive shaft 23 of the latter.

The shaft stub 28 of the drive shaft 23 of the electric motor 21 is connected releasably to the rear end wall 22 of the drum 11. For this purpose, a hub 30 is provided in the middle region of the end wall 29 of the drum 11. The hub 30 has an inner passage bore 31 which can be plugged onto the shaft stub 28. An annular receptacle extends concentrically around the passage bore 31 in the hub 30. The receptacle forms, inside the hub 30, an annular space 33 lying in the drum 11. The annular space 33 is accessible from inside the drum 11. The annular space 33 can be closed in a liquid-tight manner by means of a closing disc 34. For this purpose, the closing disc is firmly screwed and sealed off on the hub 30 and/or the shaft stub 28. By virtue of the screw connection, the closing disc 34 can be released at any time, and the annular space 33 is thereby accessible again, if required.

The annular space 33 has arranged in it a tension-ring set 35. This serves for the releasable connection of the drum 11 to the drive shaft 23 of the electric motor 21. When the tension-ring set 35 is tensioned, it presses together a sleeve portion 36 surrounding the passage bore 31 of the hub 30, with the result that the sleeve portion 36 of reduced diameter makes a frictional and non-positive connection of the hub 30 to the shaft stub 28 of the drive shaft 23 of the electric motor 21. By the tension-ring set 35 being released, the frictional and non-positive connection between the drum 11 and the drive shaft 23 of the electric motor 21 can be released. Both the tension-ring set 35 and the assignment of the latter to the outer circumference of the sleeve portion 36 of the hub 30, the said sleeve portion being seated on the shaft stub 28, provide, between the drive shaft 23 of the electric motor 21 and the drum 11, a releasable connection which can absorb not only torsional forces for the transmission of the drive torque of the electric motor 21 to the drum 11, but also bending moments. These bending moments arise due to the only one-sided mounting of the drum 11 on the electric motor 21 and due to centrifugal forces or unbalances which occur particularly during the spinning of the laundry in the drum 11.

The electric motor 21 is arranged with its axis of rotation in the prolongation of the longitudinal mid-axis 17 of the drum 11. By virtue of the direct coupling of the electric motor 21 to the drum 11 and of a relatively short design of the electric motor 21, the overall centre of gravity of the drum 11 and of the rotor 24 of the electric motor 21 is displaced into the region of the drum 11, specifically, according to the invention, into the vicinity of the dynamic centre of gravity of the drum 11 filled with the laundry to be drained. Preferably, the static centre of gravity of the drum 11 and of the drive 15 lies approximately on the longitudinal mid-axis 17. As a result, unbalance forces necessarily occurring inside the drum 11 during the spinning of the laundry exert only a low loading effect. In particular, the rolling bearing 26 of the electric motor 21, the said rolling bearing serving at the same time for mounting the drum 11 together with the laundry, is not loaded to an additional extent on account of the unavoidable unbalance, particularly at high rotational speed of the drum 11, because the static and dynamic centres of gravity lie closely to one another.

Figure 2:
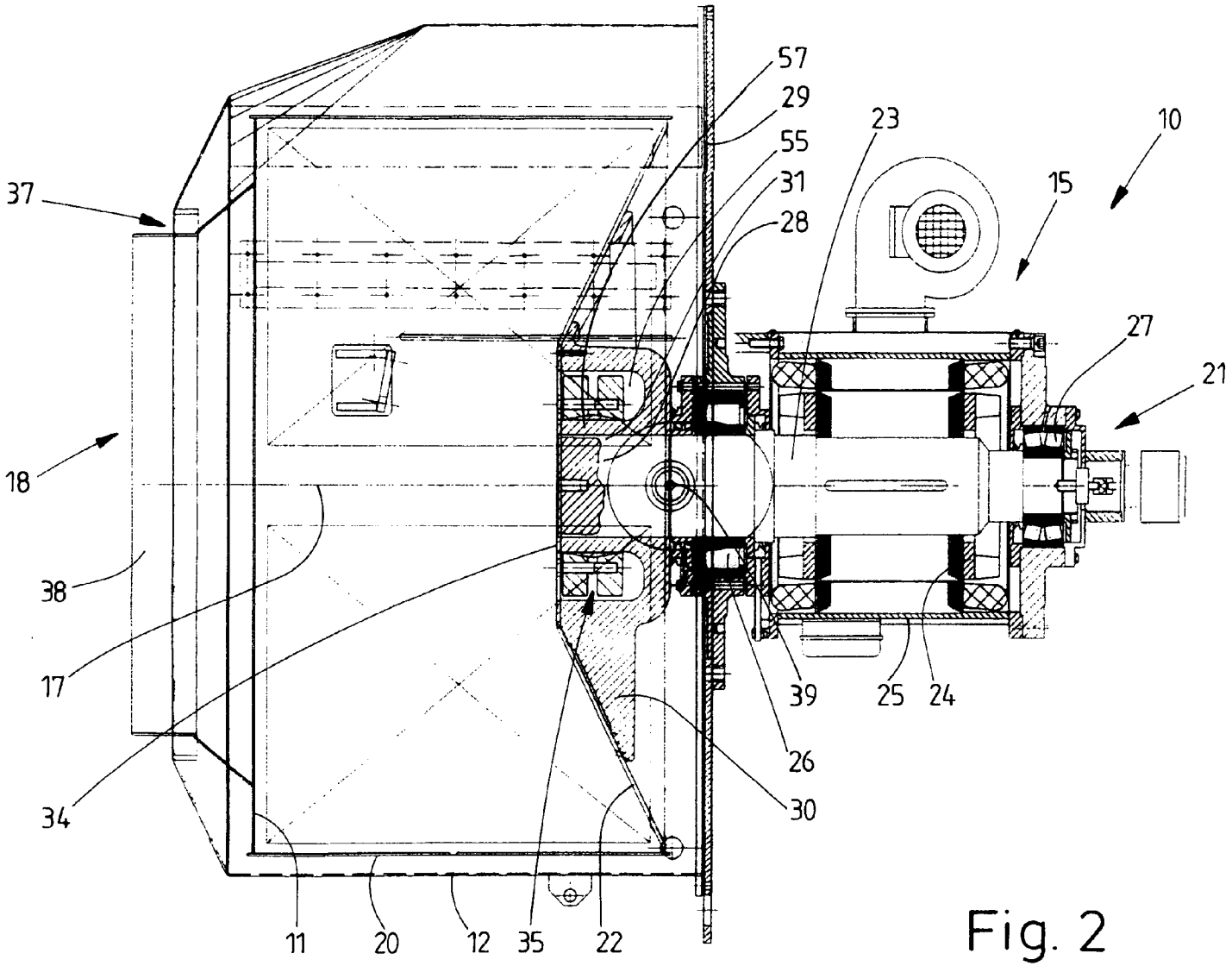
FIG. 2 shows a drum of the device of FIG. 1 with a drive in a central vertical section.
Figure 3:
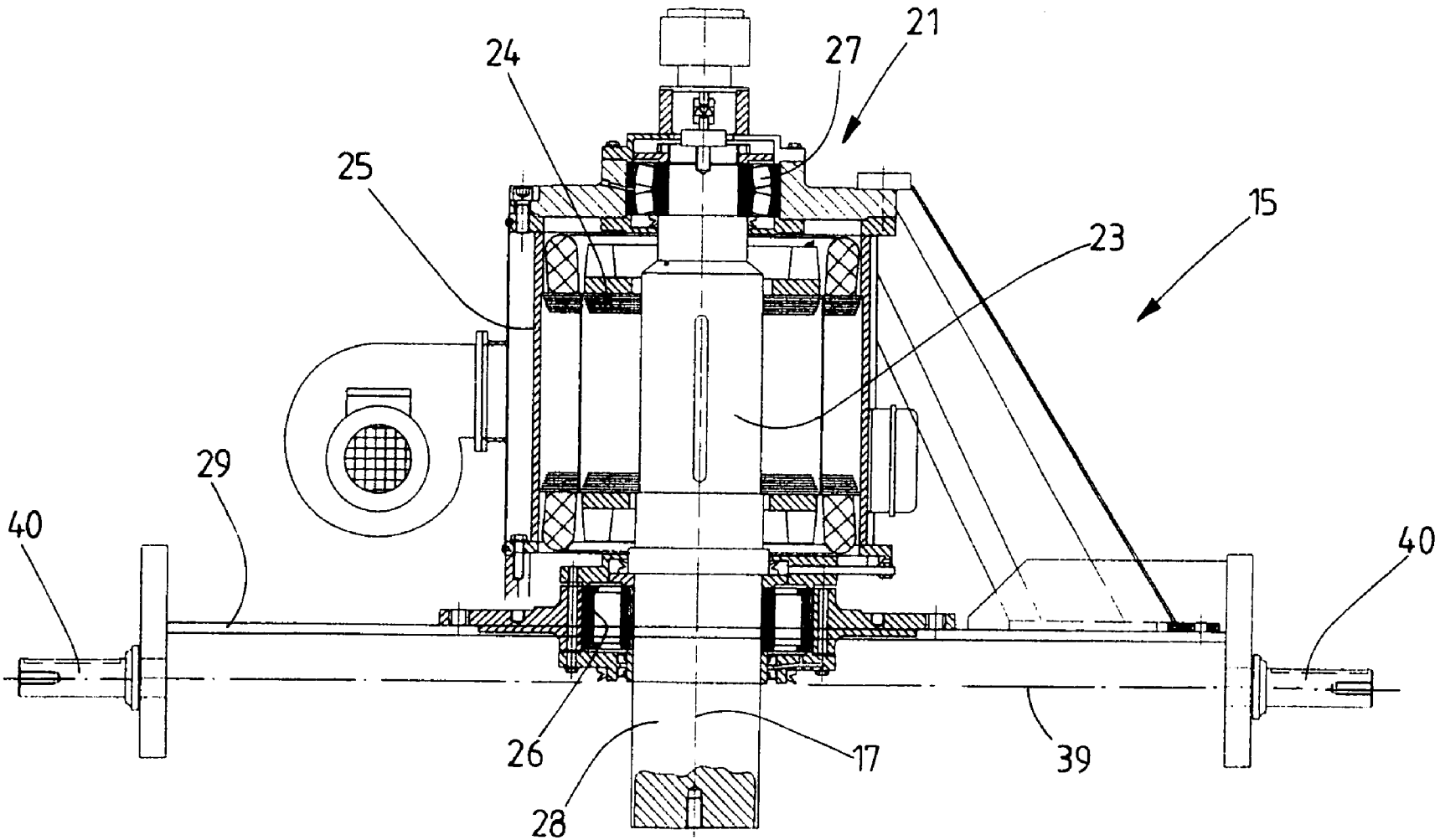
FIG. 3 shows the drive of FIG. 2 in an enlarged horizontal section.

The outer drum 12 surrounding the (inner) drum 11 capable of being driven in rotation has a liquid-tight design. The outer drum 12 is stationary. It assumes a plurality of functions: on the one hand, the outer drum 12 serves for intercepting the liquid which has been separated from the laundry and which is discharged outwards through the passage bore 19 in the surface area 20 of the drum 11. On the other hand, the outer drum 12 serves for mounting the drum 11 and the drive 15. For this purpose, as already mentioned further above, the electric motor 21 together with the stationary motor housing 25 is flanged to the rear end wall 29 of the outer drum 12. As a result, both the electric motor 21 and the drum 11 carried by the latter are mounted on the rear end wall 29 of the outer drum 12. On the front end face directed away from the rear end wall 29, the outer drum 12 has a cylindrical orifice 37 which is designed to be somewhat larger than the likewise cylindrical loading and unloading orifice 18 of the drum 11. By means of a cylindrical extension 38 surrounding the loading and unloading orifice 18 of the drum 11, the drum 11 is prolonged outwards through the orifice 37 of the outer drum 12 (FIG. 2). This ensures a reliable loading and unloading of the drum 11 with the laundry.

Figure 4:
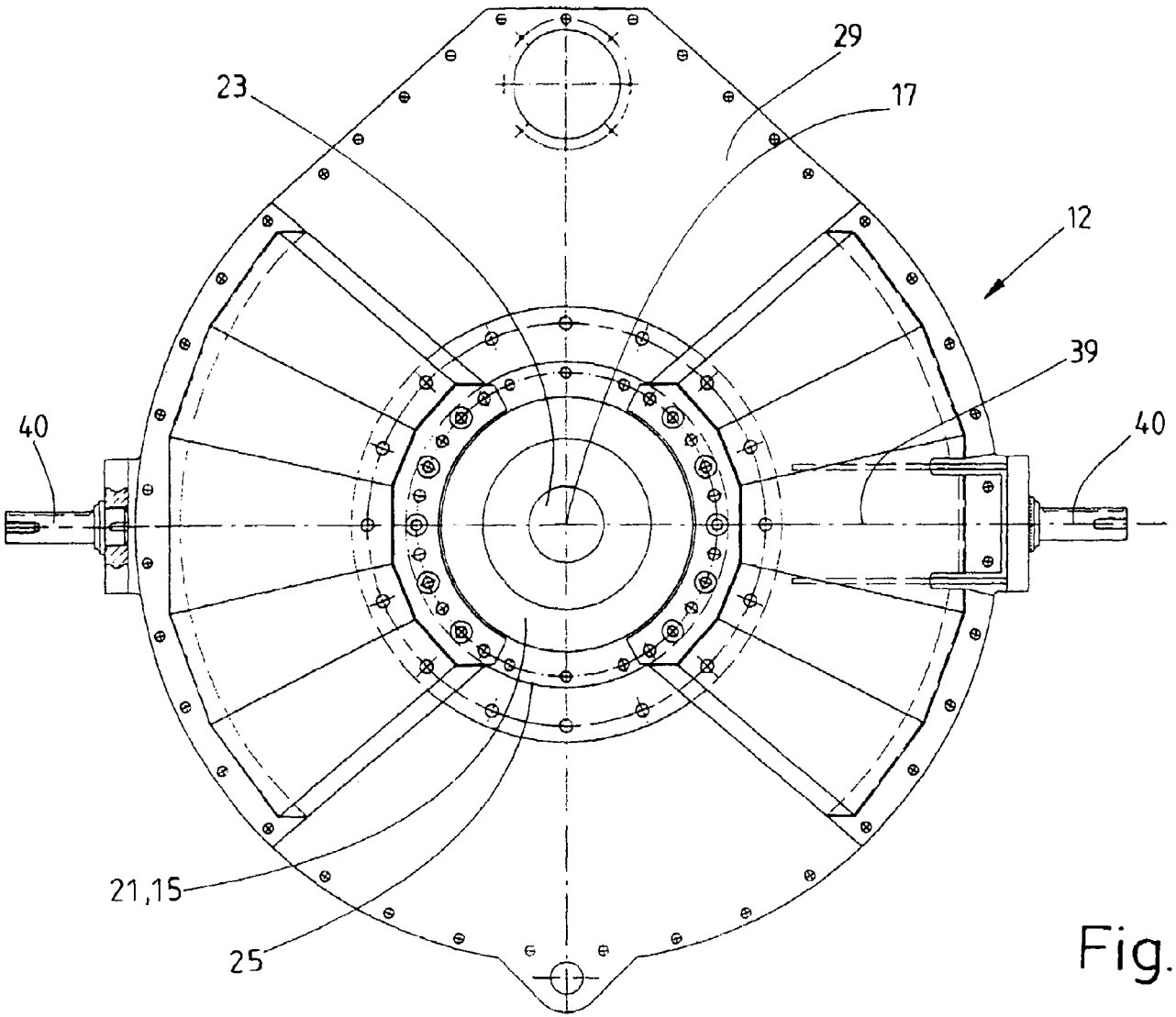
FIG. 4 shows a rear view of the drum and the drive of FIGS. 2 and 3.

The entire drum 11, together with the outer drum 12 mounted on it and together with the drive 15, is pivotable about a horizontal axis of rotation 39 which intersects perpendicularly the longitudinal mid-axis 17 of the drum 11. The axis of rotation 39 is arranged at a distance from the end wall 29 of the outer drum 12 towards the centre of the latter. The pivot axis 39 is located approximately in the plane of the rear end wall 22 of the (inner) drum 11 (FIG. 2). The pivot axis 39 has, at opposite ends, axle stubs 40 which project with respect to the outside of the outer drum 12 (FIG. 4). The pivoting drive 16 is placed directly on at least one axle stub 40, preferably on both axle stubs 40. The pivoting drive 16 is preferably an electrically operated stepping motor which can execute small pivoting movements. Alternatively, however, it is also conceivable for the respective pivoting drive 16 to be formed from a gear, for example an epicyclic gear, with a directly flanged-on electric motor. The epicyclic gear of the respective pivoting drive 16 is then seated on the respective axle stub 40. Each axle stub 40 at opposite ends of the pivot axis 39 is fastened to the bearing stand 13 via the respective pivoting drive 16. The outer drum 12, together with the drum 11 and with the drive 15, is thereby mounted on the bearing stand 13 pivotably about the pivot axis 39. Via the pivoting drives 16, the drum 11 together with the outer drum 12 and with the drive 15 can be pivoted about the pivot axis 39 in such a way that the longitudinal mid-axis 17 of the drum 11 can pass from the horizontal operating position into a position directed obliquely downwards to the loading and unloading orifice 18, for unloading the drained laundry. To load the drum 11 with wet laundry and to drain the laundry, the drum 11 together with the outer drum 12 and with the drive 15 is pivoted back into a horizontal position of the longitudinal mid-axis 17 of the drum 11 (FIG. 2).

The bearing stand 13 carrying the outer drum 12 and the drum 11 together with the drive 15 is mounted at its lower end on the plinth 14 via rubber springs 41. In the exemplary embodiment shown, each side of the outer drum 12 is assigned two identical rubber springs 41. The rubber springs 41 serve for cushioning possible unbalance oscillations of the spin dryer 10 during the run-up of the drum 11 to its final rotational speed and also during the braking of the drum 11. For this purpose, the rubber springs 41 have a corresponding spring characteristic. If appropriate, the rubber springs 41 may be fluid-filled internally, in which case the fluid pressure inside the rubber springs 41 can be varied in such a way that the rubber springs 41 as far as possible eliminate oscillations which occur and, in particular, a jumping of the drum 11 together with the laundry located in it during the acceleration and braking operation is prevented.

The plinth 14 is designed according to the invention completely or partially as a liquid collecting tank. The tank in the plinth 14 receives the liquid separated from the laundry during drainage. The total volume of the tank or of all the tanks in the plinth 14 amounts to about 1 $m^3$. After the liquid has passed through the at least partially liquid-permeable, to be precise perforated surface area 20 out of the drum 11, it is first collected in the outer drum 12 and is conducted from there via at least one suitable line into the tank in the plinth 14. The tank in the plinth 14 receives at least the entire maximum liquid occurring during a drainage operation. Preferably, however, the tank in the plinth 14 is designed in such a way that it receives the entire liquid which occurs during a plurality of, in particular two, drainage operations. For this purpose, if appropriate, a plurality of separate tanks may be arranged in the plinth, so that different liquids occurring during the drainage of different laundry items can be received separately in the plinth. The or each tank in the plinth 14 serves as a store for the liquid occurring during the drainage of the laundry, until this liquid is used elsewhere in the laundry area, for example for floating laundry to be washed into a washing machine.

The method according to the invention is distinguished in that the laundry in the drum 11 of the spin dryer 10 is acted upon with a relatively high centrifugal acceleration. According to the invention, this centrifugal acceleration is higher than 600 times gravitational acceleration. Preferably, the centrifugal acceleration of the laundry in the drum 11 amounts to 800 times to 1000 times gravitational acceleration. This centrifugal acceleration is achieved when the drum 11 has reached the maximum final rotational speed. The maximum final rotational speed of the drum 11 is dependent on its outside diameter. In the case of a drum with an outside diameter of about 1400 mm to 1500 mm, the maximum rotational speed of the drum 11 amounts to about 1000 revolutions per minute.

The drum 11 of the spin dryer 10 is loaded with wet or moist laundry with the longitudinal mid-axis 17 being horizontal, that is to say in the non-pivoted state. In this case, the drum 11 is preferably driven at a low rotational speed, so that, during loading, the laundry is distributed as far as possible uniformly onto the circumference of the surface area 20 of the drum 11. After the loading of the drum 11, with the longitudinal mid-axis 17 continuing to run horizontally, that is to say, again, without a pivoting of the drum 11, the rotational speed of the drum 11 is increased continuously to the final rotational speed. In this case, the electric motor 21 of the drive 15 is operated with maximum torque, so that the drum 11, together with the laundry located in it, is brought to the final rotational speed within the shortest possible time. During this rapid run-up of the rotational speed of the drum 11, the laundry is distributed as far as possible uniformly onto the circumference of the surface area 20, so that there is only a relatively low unbalance. Since the rotational speed at which the drum 11 is operated in order to drain the water is high according to the invention, the static centre of gravity of the drum 11, together with the rotor 24 of the electric motor 21 and together with other rotating parts of the drive 15, must lie as near as possible to the dynamic centre of gravity. This is achieved by means of the special form of construction of the drive 15 and the special coupling of the latter to the drum. In order to bring the static centre of gravity and the dynamic centre of gravity closer together or to cause them to coincide completely, the drum 11 may, if appropriate, be assigned at least one counterweight which is preferably located on that side of the drum 11 which lies opposite the drive 15. The or each counterweight then serves virtually for balancing the drum 11.

On account of the high rotational speed of the drum 11, the laundry is drained in the latter quickly and to the greatest possible extent. In this case, the effectiveness of the spin dryer 10, to be precise the degree of drainage of the latter, is comparable to the degree of the drainage of laundry presses, in which the laundry is drained mechanically by means of a ram, by the liquid being expressed.

After the drainage operation is concluded, the rotational speed of the drum 11 is quickly reduced, by the braking of the latter, to a lower rotational speed which is necessary for the complete unloading of the drained laundry from the drum 11. At the same time, by means of the pivoting drives 16, the drum 11 together with the outer drum 12 and with the drive 15 is pivoted about the horizontal pivot axis 39 running transversely to the longitudinal mid-axis 17, specifically in a direction such that the longitudinal mid-axis 17 is directed downwards to the loading and unloading orifice 18 of the drum 11.

In this case, the drained laundry comes out of the drum completely while the drive of the drum 11 continues to rotate slowly, and the adhesion of individual laundry items to or in the passage bores 19 in the surface area 20, this adhesion counteracting the automatic unloading of drained laundry, is avoided as a result of the relatively small diameters of the passage bores 19 and of the deburring or rounding of the edges of the passage bores 19 which is carried out by grinding and preferably subsequent electropolishing. After unloading, the drum 11 is pivoted back again, so that the longitudinal mid-axis 17 and the axis of rotation of the drum 11 run approximately horizontally. With the axis of rotation horizontal, the loading of the drum and the spinning of the laundry take place.

The liquid separated from the laundry during the drainage operation is first collected in the outer drum 12 and is discharged continuously from the latter into the or each tank in the plinth 14. The liquid is intermediately stored, if appropriate, in the respective tanks, until it is reused for other purposes. In this case, there is provision for the tank or all the tanks in the plinth 14 to receive completely the liquid occurring during at least two drainage operations.

In the case of laundry consisting of customary fabrics, after loading, the drum 11 is accelerated quickly to a rotational speed at which the laundry in the drum is exposed to about 800 times gravitational acceleration. The laundry is spun at this maximum gravitational acceleration for 20 to 50 s, preferably about 30 s. During this time, the rotational speed of the drum of about 1000 revolutions per minute does not change appreciably. The entire cycle time in such a spinning operation amounts to 100 to 200 s, preferably to about 120 s.

In the case of delicate laundry, for example terry cloth, dirty mats or multi-layer laminate fabrics, such as are used, for example, for breathable articles of clothing, intermediate spinning may be provided. This serves preferably for initially eliminating what are known as water pockets in the laundry. In this type of drainage of the laundry, in a first step, the drum 11 is accelerated only to an extent such that a gravitational acceleration of 40 to 300 g is exerted on the laundry. For example, the drum 11 may be driven at a rotational speed of up to 200 revolutions per minute. In this case, a large part of the water quantity, in particular water pockets, is spun out. In a next step, the drum 11 is braked, specifically to an extent such that only a gravitational acceleration of a maximum of 1 g acts on the laundry. The laundry in this case collapses, but at the same time preferably still remains adhering to the inside of the surface area of the drum 11.

In a third step, the drum is accelerated up to the maximum rotational speed of, for example, 1000 revolutions per minute, so that the maximum gravitational acceleration of 600 to 1000 g, preferably 800 g, is exerted on the laundry. The laundry is spun for 20 to 40 s, preferably for about 30 s, at this maximum rotational speed of the drum 11 and is at the same time drained.

LIST OF REFERENCE SYMBOLS

10 Spin dryer
11 Drum
12 Outer drum
13 Bearing stand
14 Plinth
15 Drive
16 Pivoting drive
17 Longitudinal mid-axis
18 Loading and unloading orifice
19 Passage bore
20 Surface area
21 Electric motor
22 End wall
23 Drive shaft
24 Rotor
25 Motor housing
26 Rolling bearing
27 Rolling bearing
28 Shaft stub
29 End wall
30 Hub
31 Passage bore
33 Annular space
34 Closing disc
35 Tension-ring set
36 Sleeve portion
37 Orifice
38 Cylindrical extension
39 Pivot axis
40 Axle stub
41 Rubber spring

What is claimed is:

1. A method for the drainage of laundry, comprising the steps of:

a) driving a drum (11) in rotation;

b) loading the drum (11) with the laundry and, during the loading, uniformly distributing the laundry onto an inner circumference of the drum (11);

c) spinning the laundry in the drum (11) at a circumferential speed such that a centrifugal acceleration that is greater than 600 times gravitational acceleration acts on the laundry such that liquid contained in the laundry is removed from the laundry, wherein the drum (11) is loaded in a position in which drainage of the liquid in the laundry also takes place and the loading of the drum (11) is carried out with the drum (11) rotating at a speed that is reduced as compared with the spinning of the laundry to remove the liquid.

2. The method according to claim 1, wherein the drum (11) comprises an approximately horizontal longitudinal mid-axis (17) or axis of rotation.

3. The method according to claim 2, further comprising the step of pivoting the drum (11) into an unloading position by means of an oblique position of the longitudinal mid-axis (17) or axis of rotation with respect to the horizontal, the longitudinal mid-axis (17) or axis of rotation being inclined downwards in the direction of a loading and unloading orifice (18) of the drum (11).

4. The method according to claim 1, further comprising the step of, after loading the drum (11) with the laundry, increasing the rotational speed of the drum quickly and continuously.

5. The method according to claim 1, wherein the drum (11) comprises a drive (15) having an electric motor (21) and the rotational speed of the drum is increased by operating the electric motor (21) at maximum torque when increasing the rotational speed of the drum (11).

6. A method for the drainage of laundry, comprising the steps of:

a) driving a drum (11) in rotation, the drum (11) comprising an approximately horizontal longitudinal mid-axis (17) or axis of rotation;

b) loading the drum (11) with the laundry and, during the loading, uniformly distributing the laundry onto an inner circumference of the drum (11) while the drum (11) is rotating at a reduced rotational speed;

c) increasing the rotational speed of the drum quickly and continuously to an increased rotational speed;

d) spinning the laundry in the drum (11) at the increased rotational speed such that a centrifugal acceleration that is greater than 600 times gravitational acceleration acts on the laundry such that liquid contained in the laundry is removed from the laundry; and e) pivoting the drum (11) into an unloading position with the longitudinal mid-axis (17) or axis of rotation in an oblique position with respect to the horizontal, the longitudinal mid-axis (17) or axis of rotation being inclined obliquely downwards in the direction of a loading and unloading orifice (18) of the drum (11).

7. The method as claimed in claim 6, wherein the drum (11) is loaded in a position in which drainage of the liquid in the laundry also takes place.

* * * * *